US006477723B1

(12) United States Patent
Jacuzzi et al.

(10) Patent No.: US 6,477,723 B1
(45) Date of Patent: Nov. 12, 2002

(54) APPARATUS AND METHOD FOR INSULATING WHIRLPOOL BATH NOISE AND VIBRATION

(75) Inventors: Remo C. Jacuzzi, Little Rock, AR (US); Remo V. Jacuzzi, Little Rock, AR (US); Tullio Jacuzzi, Alexander, AR (US); Jeffrey L. Cunningham, Little Rock, AR (US)

(73) Assignee: Jason International, Inc., North Little Rock, AR (US)

( * ) Notice: Subject to any disclaimer, the term of this patent is extended or adjusted under 35 U.S.C. 154(b) by 744 days.

(21) Appl. No.: 08/872,930

(22) Filed: Jun. 11, 1997

(51) Int. Cl.[7] ..... A47K 3/00
(52) U.S. Cl. ..... 4/541.1
(58) Field of Search ..... 4/541.1–541.5, 4/592–594, 538, 584

(56) References Cited

U.S. PATENT DOCUMENTS

| | | | | | |
|---|---|---|---|---|---|
| 4,551,869 | A | * | 11/1985 | Whitney | 4/592 |
| 4,586,204 | A | * | 5/1986 | Daniels | 4/541.4 |
| 4,938,825 | A | * | 7/1990 | Macdonald | 4/580 X |
| 5,430,898 | A | * | 7/1995 | Wang | 4/592 |
| 5,515,557 | A | * | 5/1996 | Spurlin | 4/541.1 |

FOREIGN PATENT DOCUMENTS

| | | | | |
|---|---|---|---|---|
| DE | 2300228 | * | 7/1974 | 4/584 |
| EP | 0634129 | * | 1/1995 | 4/584 |
| FR | 2344259 | * | 10/1977 | 4/592 |
| JP | 3219143 | * | 9/1991 | 4/592 |

* cited by examiner

*Primary Examiner*—Charles E. Phillips
(74) *Attorney, Agent, or Firm*—Banner & Witcoff, Ltd.

(57) ABSTRACT

The invention includes a method and apparatus for quieting and insulating a bath during its operation in order to reduce the amount of noise and vibration transmitted to its user. The bath comprises a bath vessel and a pre-molded high density insulation pad secured thereto for insulating the bath vessel from noise, vibration and heat transfer. The pre-molded insulation pad is positioned on the bottom of the bath vessel while the laminate of the bath vessel is still wet so that the pad bonds with the bath vessel as the laminate cures. After the pre-molded insulation pad has bonded to the bath vessel, an upper surface of the bath vessel is leveled with a lower surface of the pre-molded pad so that these upper and lower surfaces are parallel to each other. Further, the pump assembly is positioned away from the bath vessel during installation and operation so that vibrations generated by its pump are not directly transmitted from the pump assembly to the bath vessel. The invention also includes a method of preparing a bath for being packed into a shipping container so that the pump assembly and bath vessel are securely held together as a unit during shipping.

16 Claims, 8 Drawing Sheets

APPARATUS AND METHOD FOR INSULATING WHIRLPOOL BATH NOISE AND VIBRATION

BACKGROUND OF THE INVENTION

The present invention relates to an improved bath having a reduced noise level and greater vibration dampening construction.

Baths, especially whirlpool baths, are used for numerous purposes including relieving stress and relaxing the user. These baths typically include a bath vessel filled with a fluid, such as water, and a pump assembly which circulates the water or a combination of air and water throughout the bath vessel and its plumbing system in order to agitate the water/air mixture in contact with the bather. The operation of the pump assembly and the fluid flowing through the plumbing system typically generate a significant amount of noise and vibration which interferes with the relaxation and enjoyment of the user.

Most conventional whirlpool baths include a rigid base which commonly supports the bath vessel and the pump assembly. These baths also include rigid plumbing pipes which connect jet fittings installed on the bath vessel with the pump assembly. The vibrations created during the operation of a conventional whirlpool bath are transmitted from the pump assembly to the bath shell along the rigid base and pipes. These vibrations can be irritating and prevent the user from fully relaxing while using the bath.

Conventional whirlpool baths are installed so that their pump assemblies are positioned in close proximity to their bath vessels. This arrangement does not adequately insulate and separate the noise produced during the operation of the bath from the user. As a result, the noise generated by the pump and motor assembly mixes with that created by the fluid flowing through the plumbing and together they reach levels which may prevent a user from fully relaxing in the bath.

There is a decided need in the art for an improved bath having a construction which reduces the noise and vibration transmitted to its user so that the time spent in the bath is more relaxing and enjoyable.

It is an object of this invention to overcome the disadvantages of the prior art by providing a bath having a dramatic reduction in the pump, motor and fluid noise heard by the user and a dramatic reduction in the amount of vibration transmitted from the pump motor and fluid to the bath vessel.

SUMMARY OF THE INVENTION

Broadly defined, the present invention includes a bath which limits pump and fluid flow vibrations from being transmitted to the bath vessel and reduces the total amount of noise heard by its user. The bath vessel comprises inner and outer wall surfaces. The inner wall surfaces define an inner cavity for receiving and containing a fluid and at least a portion of a user. The outer wall surfaces substantially surround the inner wall surfaces and define an outer bath shell. A pre-molded high density insulation pad is sized to fit at least a bottom portion of the outer bath shell and secured thereto for insulating the bath vessel from noise, vibration and heat transfer.

According to a preferred embodiment of the invention, the bath further comprises a pump assembly including a separate pump and pump support stand. The pump assembly is separated from and installed independent of the bath vessel so that vibrations generated by the operation of the pump are not directly transmitted to the pre-molded insulation pad and the bath vessel.

According to a preferred embodiment of the invention, the plumbing of the bath includes at least one flexible hose section extending between the pump and the bath vessel. The vibrations generated by the operation of the pump are dampened by the pre-molded pad and the flexibility of the plumbing.

The present invention also includes a method of quieting and insulating a bath for reduced noise and vibration transfer during its operation, thereby increasing the comfort and enjoyment of its user. The method includes providing a bath vessel comprising an inner portion for containing and receiving a fluid and an outer bottom portion. A pre-molded insulation pad coated with an adhesive and sized to fit at least the bottom portion of the bath vessel is allowed to bond with the bottom of the bath vessel so that it is secured thereto. The method also comprises the step of leveling the upper surface of the bath vessel with the lower surface of the pre-molded pad so that these upper and lower surfaces are parallel to each other.

In a preferred embodiment of the invention, the pre-molded high density insulation pad includes a foam, preferably, a polyurethane foam. Also, the pre-molded insulation pad is applied to a wet bath shell laminate so that the pad bonds to the bath vessel as the laminate cures and hardens.

The present invention further includes a method of preparing a bath for being packed into a shipping container. The method includes providing a bath comprising a bath vessel having an insulation pad and bracket secured thereto and a pump assembly. The method also includes securing a removable shipping pallet board to the pump assembly. The bracket secured to the bath vessel is connected to the shipping pallet board so that the bath vessel and the pump assembly are substantially fixed relative to each other during shipping. A support strap is extended around a portion of the pump assembly and the bath vessel to further fix the bath vessel and pump assembly during shipping. The height of the bottom of the pallet board is adjusted relative to the bath vessel so that the bottom of the pallet board is level with the bottom of the insulation pad. Also, pieces of a cushioning material are placed over corners of the bath vessel and along its edges to protect the bath vessel from being damaged. The method further includes placing an upper end of a corner support post under a lip of the bath vessel and placing a lower end of the support post so that it interlocks with the shipping pallet board in such a manner that the bath vessel and pump assembly are securely held together as a unit for shipping.

DETAILED DESCRIPTION OF THE PREFERRED EMBODIMENT

Figure 1:
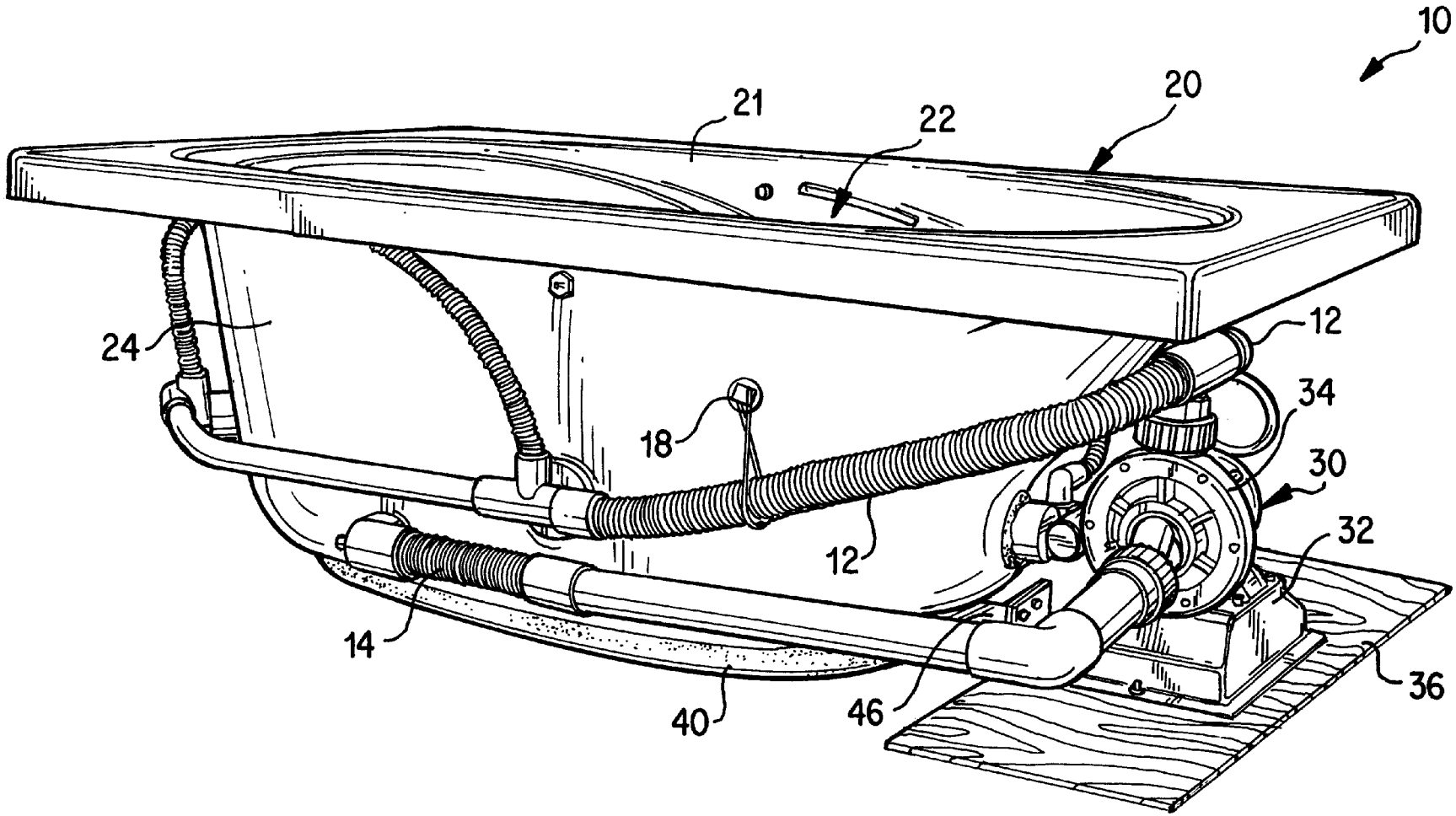
FIG. 1 is a perspective view illustrating a bath having the construction of the preferred embodiment.

FIG. 1 shows a bath 10 including a bath vessel 20 and a pump assembly 30. The bath vessel includes inner wall surfaces 21 forming an inner cavity 22 for receiving fluids such as water, air or a combination of both. The inner wall surfaces 21 are designed to be aesthetically appealing and physically comfortable for a bather. The bath vessel 20 also includes outer wall surfaces substantially surrounding the inner cavity 22 and defining an outer bath shell 24 which provides strength and rigidity to the inner cavity 22. The bath vessel 20 is prepared using a conventional, well-known process which laminates layers of material, such as fiberglass, to form a shell. The pump assembly 30, best shown in FIGS. 1 and 5, includes a pump support stand 32 and a pump 34. The pump 34 is a conventional pump used with whirlpool baths and is secured to the pump stand 32 in a conventional manner.

The bath 10 is assembled and installed in a manner which allows for the vibrations and noises produced by the operation of the pump and fluid flowing through the plumbing to be significantly dampened or eliminated before reaching the user. It is to be understood that the term "bath" encompasses whirlpool baths, tubs, spas, and other such known fluid enclosures.

Figure 4:
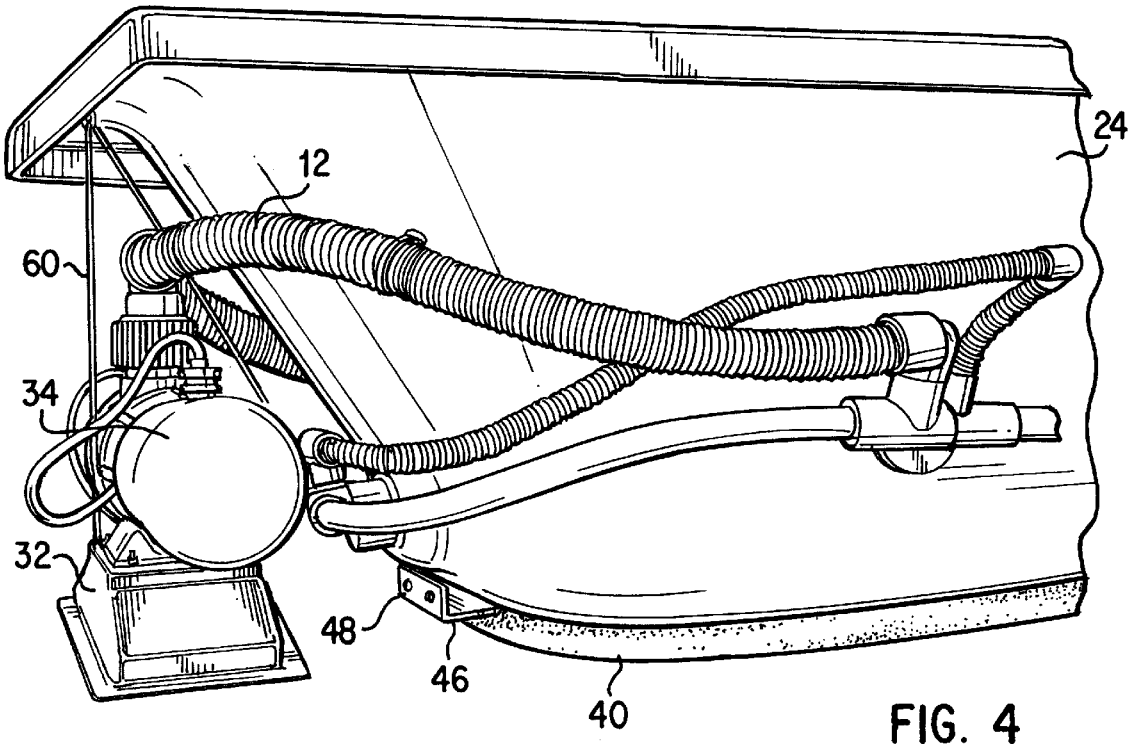
FIGS. 4 and 5 are side views illustrating the plumbing of the preferred embodiment.
Figure 5:
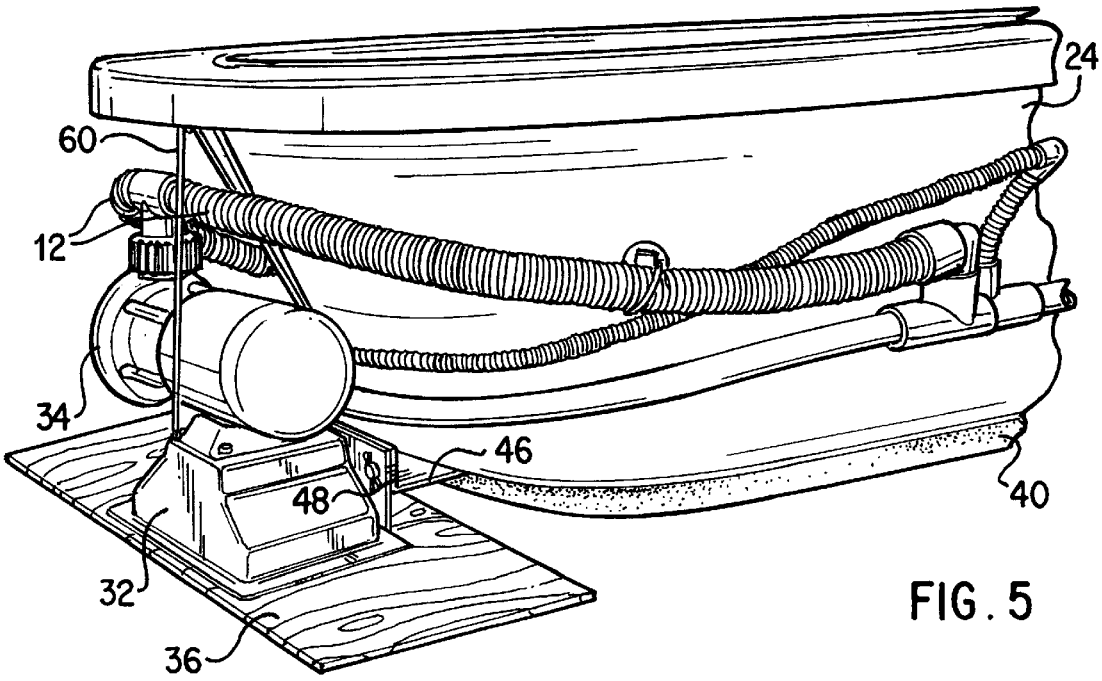

As shown in FIGS. 1, 4 and 5, flexible hoses 12 are placed between the pump and the fluid jets. Also, a flexible hose 14 is located in the bath's suction line. The hoses 12, 14 are formed of a flexible material such as flexible PVC so that vibrations transmitted to the plumbing from pump 34 are dampened before they reach the bath vessel 20. Other known flexible plumbing hoses may be used in place of the PVC hose. The diameter of flexible hose 12 is larger than that present normally used in the industry. The increased diameter reduces water noise by reducing the velocity of the water traveling to the jet without effecting the strength of the jet or the strength of the fluid expelled by the jet. This hose has a diameter of between 1 and 2 inches and preferably a diameter of between 1¼ inches and 1½ inches with the most preferable diameter being about 1¼ inches. The flexible hose 14 has a diameter of between 1¼ inches and 2¼ inches with a preferred diameter of between 1½ inches and 2 inches. The most preferred diameter for the suction hose is about 1½ inches. The bath vessel 20 carries a plurality of tie buttons 18 for supporting the plumbing hoses which extend along its sides and to support the pump during shipment via the pump strap 60.

Figure 2:
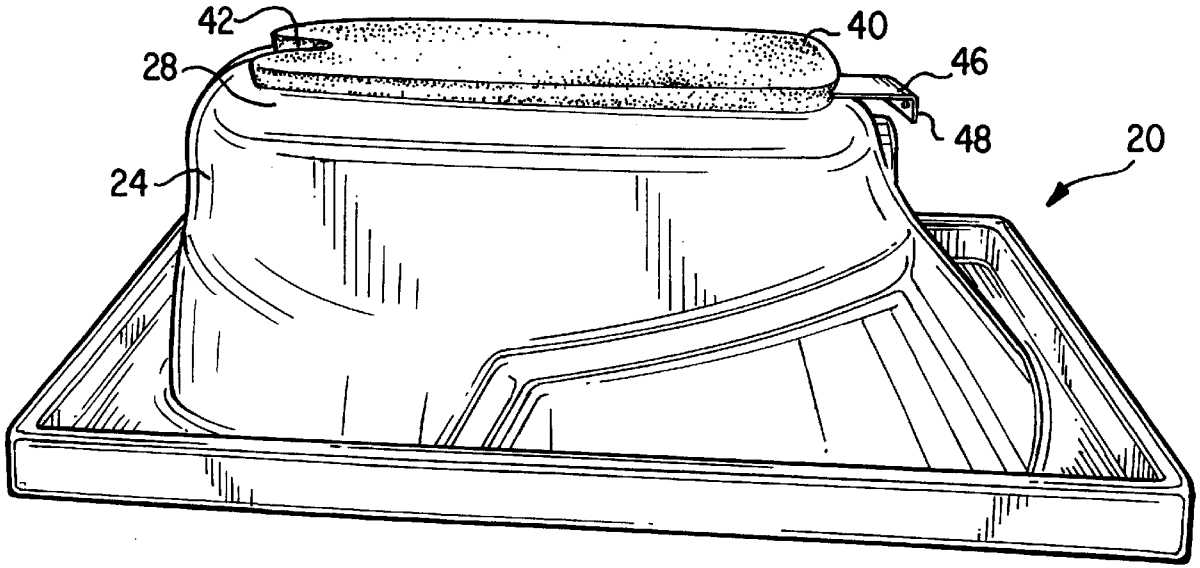
FIG. 2 is a side view illustrating the location of the insulation pad on the bath vessel.
Figure 3:
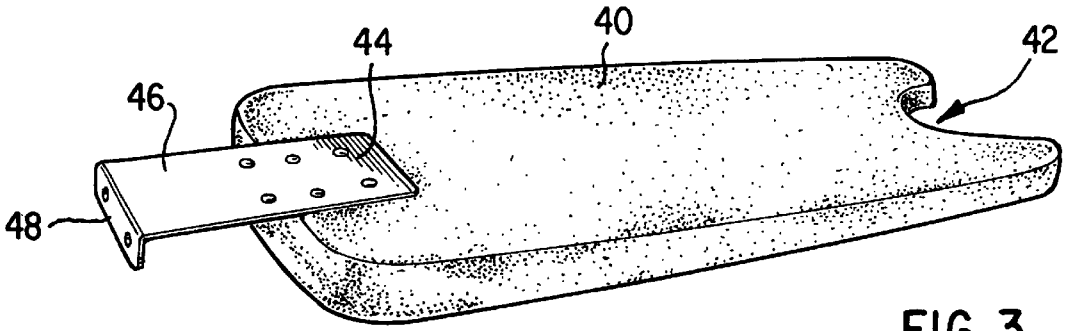
FIG. 3 is a perspective view illustrating the insulation pad and bracket.

As best seen in FIGS. 2 and 3, the bath also includes a pre-molded high density insulation pad 40 secured to at least the bottom portion 28 of the outer bath shell 24. The pad 40 is shaped to mate with the portion of the bath vessel 20 to which it is applied. The pad 40 is also shaped to accommodate the bath's plumbing. As shown in FIG. 2, a recess 42 is formed at one end of the pad allowing plumbing for a drain to extend therethrough. Other known types of openings may be used to accommodate the bath's plumbing.

The pad 40 provides the bath 10 with increased vibration dampening as compared to traditional baths and reduces heat loss. Before being placed on the bath vessel, the pad 40 is pre-molded of a polyurethane foam having a minimum density of three pounds per cubic foot up to a maximum in the order of eight pounds per cubic foot. One such acceptable polyurethane foam is available from the IPI Company located in Elkton, Md. and sold under the trade name ISO-Foam. It is contemplated that other foams having a density in the order of three to eight pounds per cubic foot could also be used. Preferably, the density should be about five pounds per cubic foot.

The pad 40 is formed to match the size and shape of the bottom of the bath, as well as its plumbing. As a result, the pad 40 substantially covers the bottom surface of the bath when secured thereto. In the preferred embodiment, the pad 40 is pre-molded before being secured to the bottom of the outer bath shell 24 by depositing a polyurethane foam into a single cavity mold and allowing it to rise and cure. Preferably, the mold has a size and shape which correspond to the lower surface of the outer bath vessel so that little or no work needs to be performed on the pad after it has been removed from the mold. A mold having a generic shape may also be used. Once cured, the pad is removed from its mold and, if necessary, shaped to correspond to the bottom of the outer bath shell. A bracket 46 is then attached to the shaped pad and both are sprayed with an adhesive, preferably a polyester resin mixture. The sprayed pad 40 and bracket 46 are then placed on the bottom of the vessel 20 while the laminate is still wet so that the pad and bracket can bond with the vessel as the laminate cures to create a strong, effective union between the insulation pad 40 and the bath vessel 20.

The pad 40 may also be formed directly on the bath vessel 20. This is accomplished by placing an open top and bottom mold onto a laminated bottom surface 28 of the outer bath shell 24. A polyurethane foam is then deposited into the mold and spread over the bottom surface 28 of the outer bath shell 24 and bracket 46. As discussed above, the foam is allowed to rise and cure before the mold is removed.

After the laminate of the bath vessel has fully cured and bonded with the pad 40, the lower surface of the insulation pad is leveled with a top deck of the bath vessel. In a preferred manner of leveling, the bath vessel and pad are passed through a saw which trims the pre-molded pad as necessary so that the upper deck and lower surface are parallel. After the plumbing has been installed between the pump assembly 30 and the bath vessel 20, the bath 10 is prepared for shipping.

Figure 6:
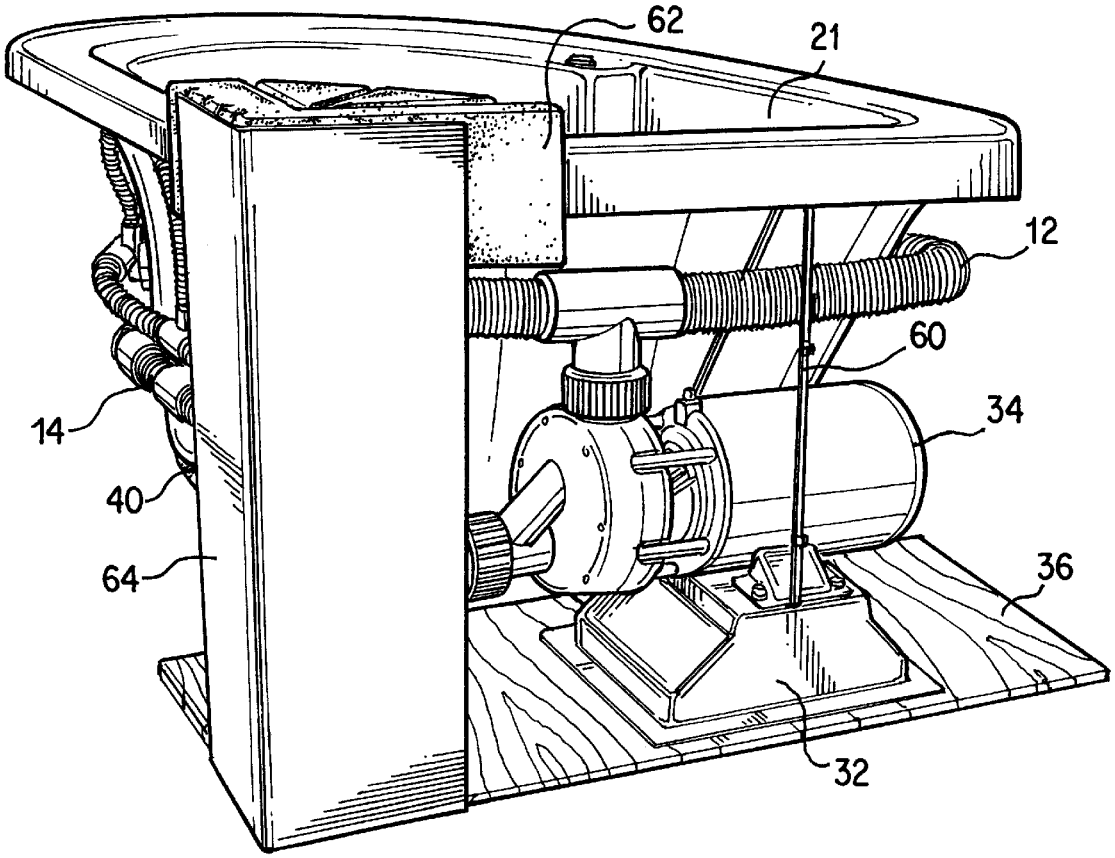
FIGS. 6 and 7 illustrate a corner of the bath when prepared for shipping.
Figure 7:
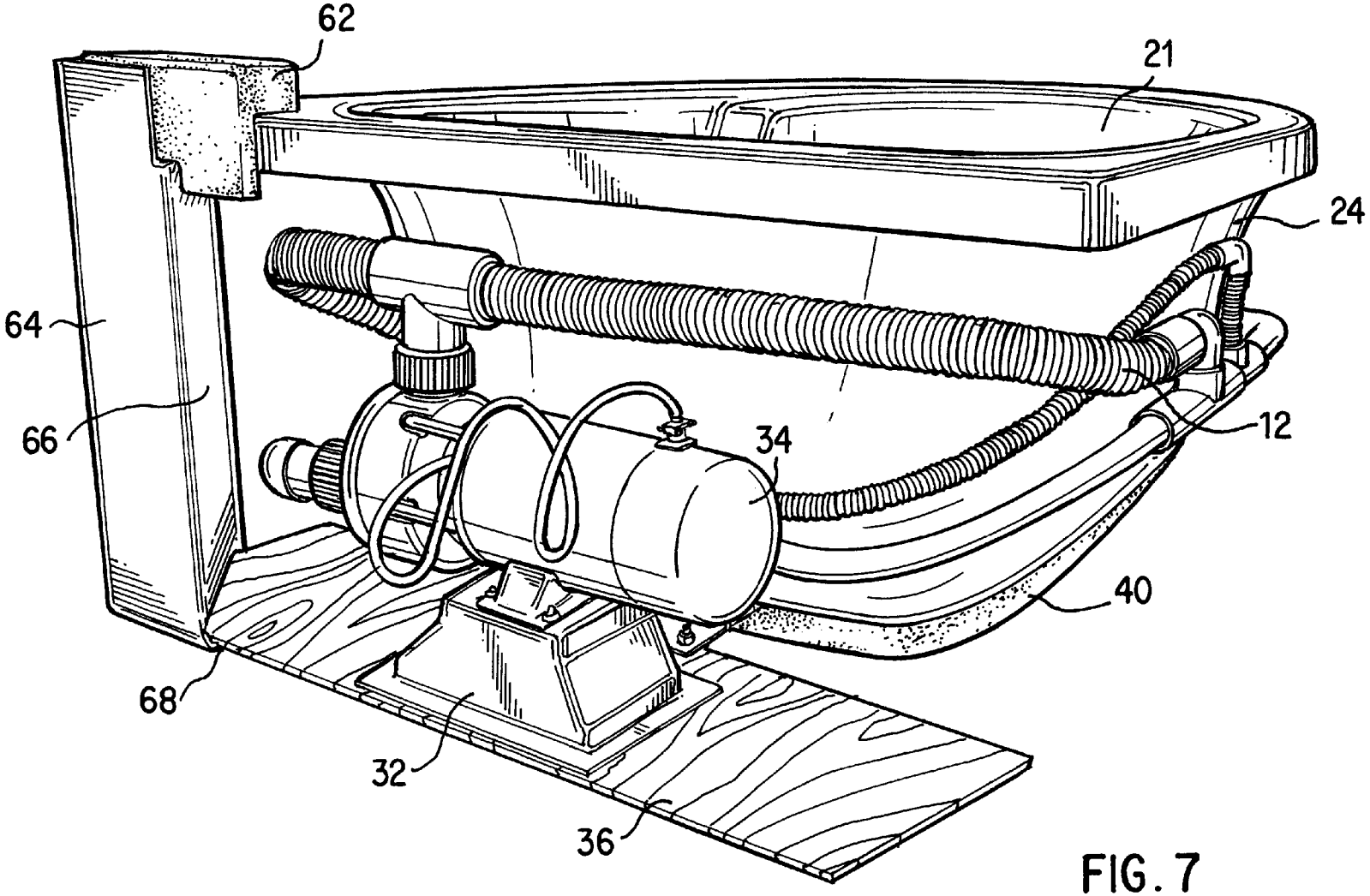
Figure 8:
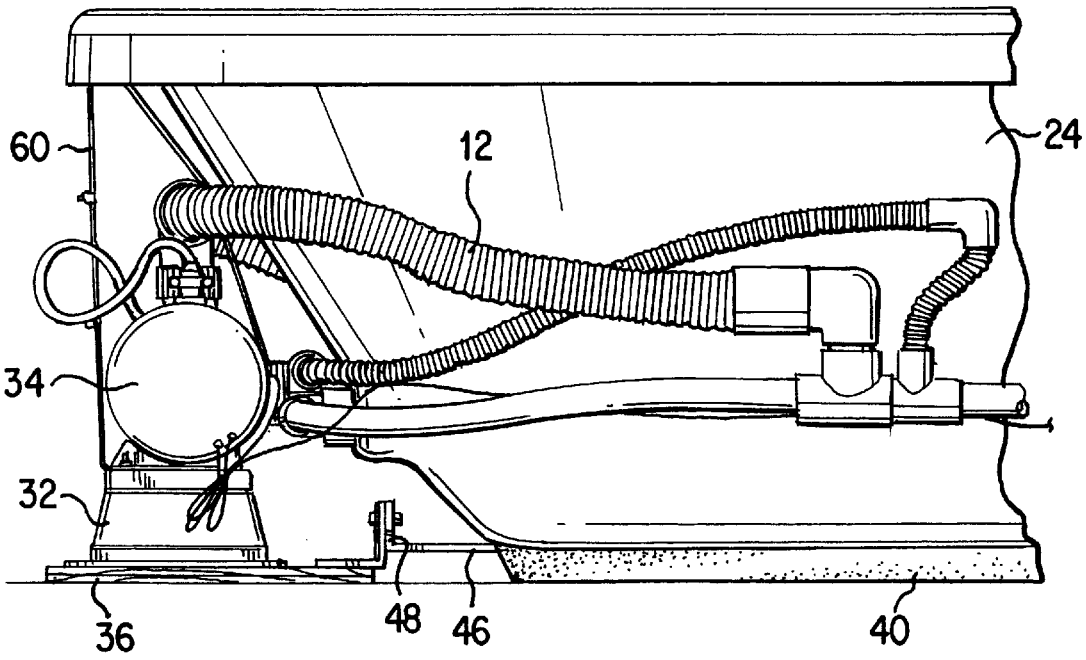
FIG. 8 is a side elevational view illustrating the plumbing and outer shell of the bath.
Figure 9:
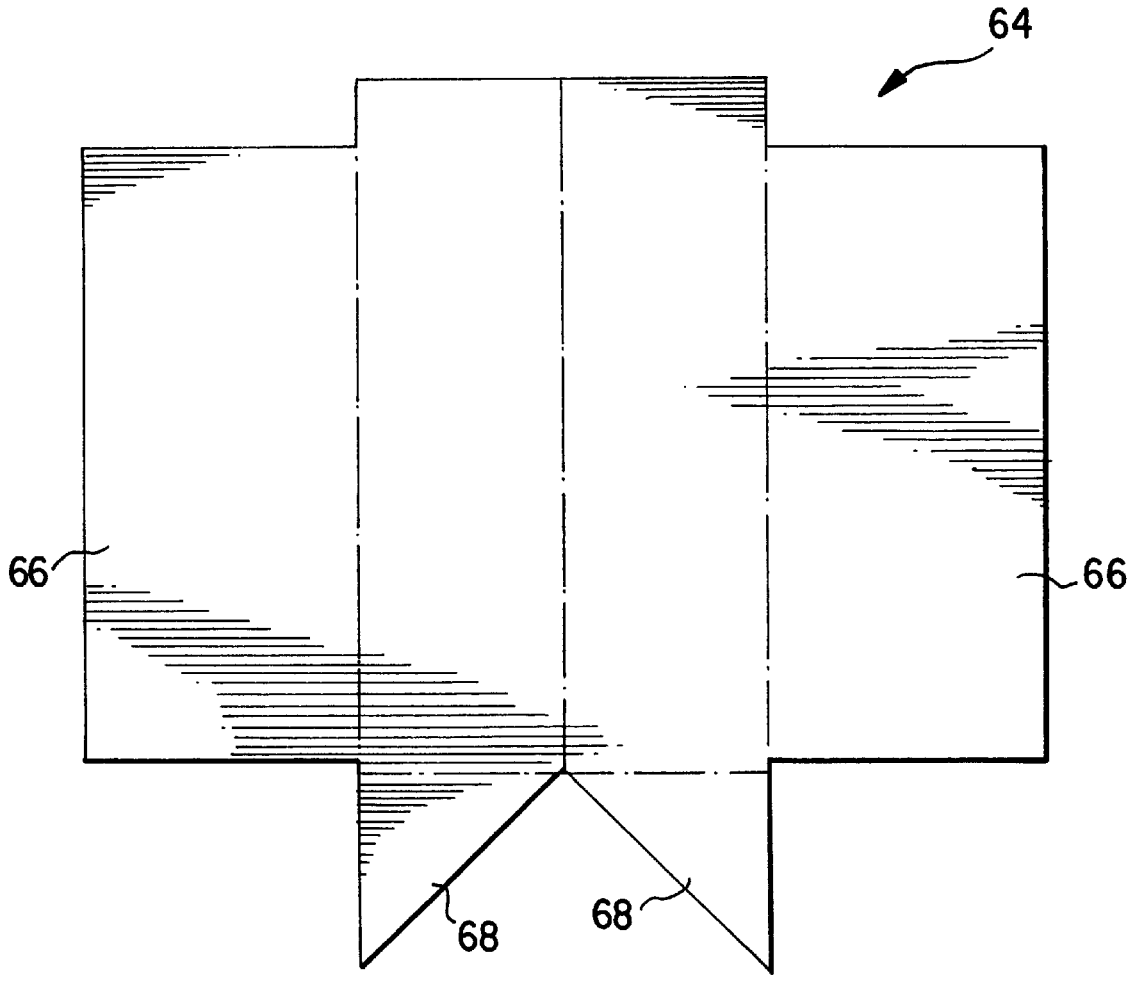
FIG. 9 illustrates an unfolded corner post.
Figure 10:
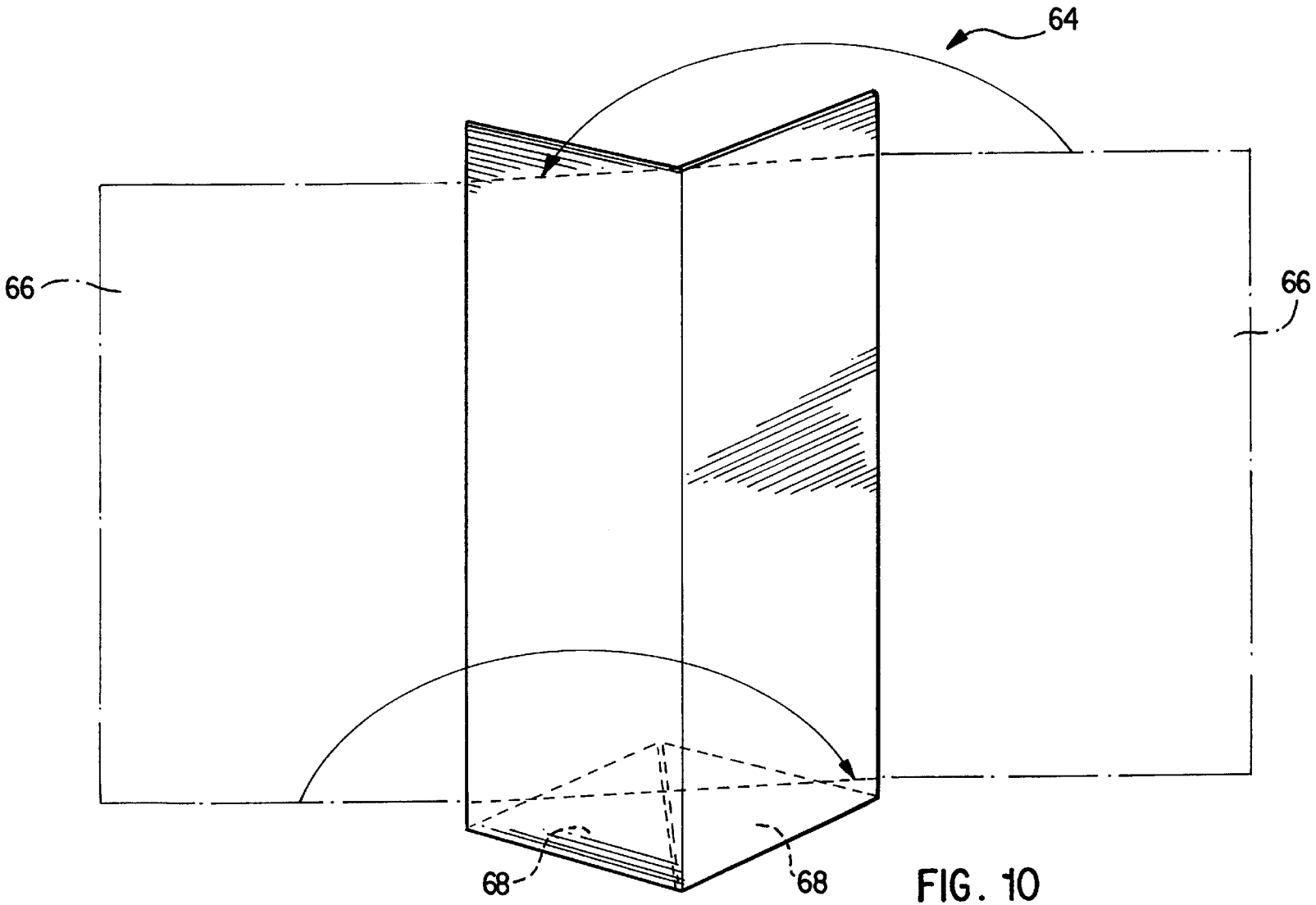
FIG. 10 illustrates how the corner post is folded.

In preparation for shipping the bath, the pump assembly 30 and bath vessel 20 are operatively secured to each other by a shipping pallet board 36 and the bracket 46. As shown in FIGS. 6–8, the shipping pallet board 36 is secured to a lower surface of pump stand 32 in a conventional manner for support. The bracket 46 has a first end 44 secured between the outer bath shell 24 and the pad 40 as previously discussed. A second end 48 of the bracket 46 extends away from the bath vessel 20 and the pad 40 in the direction of the pump assembly 30. The second end 48 is secured to the shipping pallet board 36 by threaded fasteners or the like to fix the position of the bath vessel relative to the pump assembly. A strap 60 is used in addition to the bracket 46 and threaded fasteners to secure the pump assembly 30 to the bath vessel 20. Other known connectors for securing the pump assembly 30 to the bath vessel 20 may be used in place of the strap 60. The height of the pallet board 36 may also be adjusted so that its lower surface is level with the bottom of the insulation pad 40 during shipping. Pieces of cushioning material 62 such as STYROFOAM are placed over the corners and along the edges of the bath vessel 20 so that the vessel is not damaged. Each piece of cushioning material is supported by a corner post 64 having a triangular cross section. As shown in FIGS. 9 and 10, each corner post 64 is formed by folding vertical side flaps 66 toward each other and the center of the post. A lower end of each corner post includes end flaps 68 which are folded under the pallet board 36 to secure the post 64 relative to the pallet board 36 so that the bath vessel 20 and pump assembly 30 are securely held together as a unit for shipping.

During installation of the bath, the pump assembly 30 and bath vessel 20 are separated from each other so that the pump assembly 30 can be installed away from and independent of the position of the bath vessel 20 within the limits imposed by the plumbing of the bath. This separation significantly contributes to the reduction in noise and vibration transmitted to the bath vessel during operation of the pump. Separation is accomplished by disconnecting bracket 46 from shipping pallet board 36 and removing strap 60. Before the pump assembly is installed, the shipping pallet board is also removed.

Many possible embodiments of the invention may be made without departing from the scope thereof which is defined by the appended claims. It is to be understood that all the matter set forth herein or shown in the drawings is illustrative and not limiting to the present invention.

We claim:

1. A bath vessel for use with a fluid pump to relax and comfort a user comprising:

inner wall surfaces defining an inner cavity for receiving and containing a fluid therein;

outer wall surfaces defining an outer bath shell, said outer wall surfaces including a bottom surface and sidewalls extending upwardly from said bottom surface; and a high density insulation pad for absorbing vibrations, said insulation pad being sized and arranged to substantially cover said bottom surface, said insulation pad being secured to said bottom surface such that said sidewalls are positioned entirely above said pad.

2. The bath vessel of claim 1 wherein said insulation pad is formed with a recess at one end for receiving plumbing capable of being attached to the bath shell.

3. The bath of claim 1 wherein said pad includes a polyurethane foam material having a density of at least 3 pounds per cubic foot.

4. The bath of claim 1 wherein said insulation pad includes a coating of a polyester resin.

5. The bath vessel of claim 1 wherein said insulation pad is bonded to said bottom surface.

6. The bath vessel of claim 1 wherein said insulation pad is a pre-molded foam insulation pad.

7. A bath for relaxing and comforting a user comprising:

inner wall surfaces defining an inner cavity for receiving and containing a fluid therein;

outer wall surfaces substantially surrounding said inner wall surfaces and defining an outer bath shell, said outer wall surfaces including a bottom surface and sidewalls extending upwardly from said bottom surface;

a high density insulation pad for absorbing vibrations, said insulation pad substantially covering said bottom surface and being secured thereto such that said sidewalls are positioned entirely above said pad; and a pump assembly comprising a pump and pump support stand, wherein said pump assembly is spaced from said insulation pad so that noises and vibrations generated by the operation of said pump are isolated from said bath shell and the user.

8. The bath of claim 7 wherein said insulation pad is formed with a recess at one end thereof for receiving plumbing capable of being attached to the bath shell.

9. The bath of claim 7 wherein said insulation pad includes a polyurethane foam material.

10. The bath of claim 7 wherein said insulation pad includes a coating of a polyester resin.

11. A bath for relaxing and comforting a user comprising:

inner wall surfaces defining an inner cavity for receiving and containing a fluid therein;

outer wall surfaces substantially surrounding said inner wall surfaces and defining an outer bath shell;

a high density insulation pad for absorbing vibrations, said insulation pad substantially covering a bottom surface of said outer bath shell, said insulation pad being secured to said bottom surface such that said outer wall surfaces are positioned entirely above said insulation pad;

a pump assembly comprising a pump and a pump support stand secured to said pump, said pump assembly being spaced away from said insulation pad during operation of the bath so that noises and vibrations generated by the pump are isolated from said bath shell; and at least one flexible hose extending between said pump and said outer bath shell, whereby vibrations generated by the operation of the pump are dampened by said pad and said at least one flexible hose.

12. The bath of claim 11 wherein said insulation pad is bonded to said bottom surface of said outer bath shell.

13. The bath vessel of claim 11 wherein said insulation pad is a pre-molded foam insulation pad.

14. A bath for relaxing and comforting a user comprising:

inner wall surfaces defining an inner cavity for receiving and containing a fluid therein;

outer wall surfaces substantially surrounding said inner wall surfaces and defining an outer bath shell, said outer wall surfaces including a bottom surface and sidewalls extending upwardly from said bottom surface;

a high density insulation pad for absorbing vibrations, said insulation pad substantially covering said bottom surface and being secured thereto such that said sidewalls are positioned entirely above said pad;

a pump assembly comprising a pump and a pump support stand, wherein said pump assembly is spaced from said insulation pad so that noises and vibrations generated by the operation of said pump are isolated from said bath shell and the user; and a bracket attached to said pad and secured between a portion of said pad and said outer bath shell, said bracket being operatively securable to said pump support stand so that the pump support stand is operatively attached to the pad and the bath shell during assembly of the bath and detached therefrom during installation of the bath.

15. A bath vessel for use with a fluid pump to relax and comfort a user comprising:

inner surfaces defining an inner cavity for receiving and containing a fluid therein;

outer wall surfaces including an outer bath shell, said outer wall surfaces including a bottom surface and sidewalls extending upwardly from said bottom surface;

a high density insulation pad for absorbing vibrations, said insulation pad being sized an arranged to substantially cover said bottom surface, said insulation pad being secured to said bottom surface such that said sidewalls are positioned entirely above said pad; and a bracket attached to said pad and secured between a portion of said pad and said bottom surface of said outer bath shell for being operatively secured to the fluid pump.

16. A bath for relaxing and comforting a user comprising:

inner wall surfaces defining an inner cavity for receiving and containing a fluid therein;

outer wall surfaces substantially surrounding said inner wall surfaces and defining an outer bath shell;

a high density insulation pad for absorbing vibrations, said insulation pad substantially covering a bottom surface of said outer bath shell, said insulation pad being secured to said bottom surface such that said outer wall surfaces are positioned entirely above said insulation pad;

a pump assembly comprising a pump and a pump support stand secured to said pump, said pump assembly being spaced away from said insulation pad during operation of the bath so that noises and vibrations generated by the pump are isolated from said bath shell;

at least one flexible hose extending between said pump and said outer bath shell, whereby vibrations generated by the operation of the pump are dampened by said pad and said at least one flexible hose; and a bracket attached to said pad and secured between a portion of said pad and said bottom surface of said outer bath shell, said bracket being operatively securable to said pump support stand so that the pump support stand is operatively attached to the pad and the bath shell during assembly of the bath and detached therefrom during installation of the bath.

* * * * *

UNITED STATES PATENT AND TRADEMARK OFFICE

CERTIFICATE OF CORRECTION

PATENT NO. : 6,477,723 B1
DATED : November 12, 2002
INVENTOR(S) : Remo C. Jacuzzi et al.

It is certified that error appears in the above-identified patent and that said Letters Patent is hereby corrected as shown below:

Column 5,
Lines 39 and 42, -- vessel -- has been inserted after "The bath";
Line 60, -- a -- has been inserted before "pump support";

Column 6,
Line 57, -- wall -- has been inserted after "inner";
Line 59, "including" has been replaced with -- defining --;
Line 64, "an" has been replaced with -- and --.

Signed and Sealed this

Thirteenth Day of July, 2004

JON W. DUDAS
*Acting Director of the United States Patent and Trademark Office*